US006821002B1

(12) United States Patent
Morgen

(10) Patent No.: US 6,821,002 B1
(45) Date of Patent: Nov. 23, 2004

(54) LIGHTBOX LAMPSHADE

(76) Inventor: Paula A. K. Morgen, 5828 Main St., Elkridge, MD (US) 21075

( * ) Notice: Subject to any disclaimer, the term of this patent is extended or adjusted under 35 U.S.C. 154(b) by 0 days.

(21) Appl. No.: 10/425,050

(22) Filed: Apr. 28, 2003

(51) Int. Cl.[7] ..... F21V 11/00

(52) U.S. Cl. ..... 362/351; 362/354; 362/360; 362/808

(58) Field of Search ..... 362/351, 352, 362/353, 354, 355, 356, 357, 358, 359, 360, 361, 311, 223, 806, 808; 40/627, 571, 554, 366, 367

(56) References Cited

U.S. PATENT DOCUMENTS 1,463,722 A * 7/1923 O'Boyle ..... 428/14
2,177,204 A * 10/1939 Buzick et al. ..... 40/554
2,680,317 A * 6/1954 Lewis ..... 40/554
3,105,315 A * 10/1963 Snethen ..... 40/502
3,222,517 A 12/1965 Peter
3,456,106 A * 7/1969 Gluschkin ..... 362/98
4,163,998 A 8/1979 Anderson et al.
4,164,822 A 8/1979 Batton
4,242,821 A 1/1981 McNeil
4,268,896 A 5/1981 Mann
4,337,505 A 6/1982 Heimo
4,344,115 A 8/1982 Pickens et al.
4,817,315 A 4/1989 Kammerer et al.
5,224,283 A 7/1993 Maratta
5,373,428 A 12/1994 Day
6,183,115 B1 2/2001 Durando
6,647,651 B2 * 11/2003 Cutright ..... 40/431

* cited by examiner

*Primary Examiner*—Thomas M. Sember
*Assistant Examiner*—B Q T
(74) *Attorney, Agent, or Firm*—William S. Ramsey

(57) ABSTRACT

This invention combines a lampbox and lampshade. The lampbox lampshade provides a uniform illumination for the transmitted light viewing of photographic slides removably attached to the outside of the lampshade. Optimum viewing conditions are insured by the fact that no surfaces are interspersed between the surface of the slides and the eye of the viewer. The normal functions of a lampshade are not affected.

20 Claims, 11 Drawing Sheets

LIGHTBOX LAMPSHADE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

This invention relates to lampshades.

2. Description of Related Art Including Information Disclosed Under 37 CFR 1.97 and 37 CFR 1.98

This invention is a lampshade with flat translucent sides to which photographic slides and other transparencies are mounted, which allows the convenient viewing and examination of photographic slides or other transparencies. The slides can be removed and replaced to update the display.

U.S. Pat. No. 3,222,517 discloses a collapsible lampshade with sides connected by hinges to a square frame. The lampshade has an opening to be covered with a shade material passing light therethrough. The sides of the shade are hinged by ears and sockets, the ears retained in place by ridges on the ears and grooves on the sockets. The sides of the shade are locked in place by short pins inserted into holes at the tops of the uppermost ears and sockets. A single brace is used to attach the lampshade to the lampbase and extends from two opposed sides.

U.S. Pat. No. 4,163,998 discloses a cone shaped lampshade with a picture display window. The lampshade is opaque with a window opening behind which are an inner sheet and an outer sheet, both preferably translucent, although one or both may be transparent. A replaceable picture is mounted between the inner and outer sheet.

U.S. Pat. No. 4,164,822 discloses a lightbox for use with maps with a horizontal surface illuminated by a lamp assembly behind the surface and which is illuminated only when a map is placed on the lightbox in the correct orientation.

U.S. Pat. No. 4,242,821 discloses a lightbox as pictorial or advertising display units. The lightbox is of inexpensive construction with a one piece molded frame with grooves for retaining the pictorial display.

U.S. Pat. No. 4,268,896 discloses a lampshade which comprises a support having two opposed vertical support members with grooves which receive two a rectangular place mats or wall pictures each of which is bent into a hemisphere with the edges retained by the grooves. The place mat or picture is illuminated by the light passing through the picture.

U.S. Pat. No. 4,337,505 discloses a holder for light-transmissive pictures which comprises two curved transparent or light transmissive plastic sheets or foils formed in a tubular form with the ends overlapping. Rings cover and secure the ends of the tube which is formed. A light bulb inside the tube provides illumination for light-transmissive pictures mounted between the foils.

U.S. Pat. No. 4,344,115 discloses a ceiling mounted plastic translucent lampshade with decorative self-adhesive contact paper attached. The contact paper can be chanced if the decor of the room is changed.

U.S. Pat. No. 4,817,315 discloses a three dimension display device with a first translucent panel having an art motif over which a second picture (or other object) is mounted, thereby giving a three-dimension effect when illuminated by the lamp and viewed through a viewing aperture cut in the lampshade.

U.S. Pat. No. 5,373,428 discloses a lightbox for display purposes. The lightbox is mounted vertically with a flexed facia consisting of outer and inner panels between which is placed a photographic transparency.

U.S. Pat. No. 5,224,283 discloses a lightbox with a number of illuminated panels mounted at a 45° angle. A number of masking cards each having a different sized opening are attached to the panels. A negative to be cropped is placed on the various cards and the negative is taped to the card having the most appropriate opening to best display the features of the negative.

U.S. Pat. No. 6,183,115 discloses a lampshade with a projection lens which projects the image from a slide within the lampshade to the ceiling. The lampshade has vents about the circumference and a fan for cooling the interior.

None of the discovered prior art provides the advantages of the present invention, that is, providing a combination lightbox and lampshade for the convenient viewing and study of photographic slides as well as allowing for conventional use of a lamp with a lampshade.

BRIEF SUMMARY OF THE INVENTION

This invention provides the even illumination and support of a light box for the viewing and study of photographic slides with the decorative and functional effects of a lampshade. It is especially suitable for the display of vacation trip, wedding, or other thematic series of photographs. The lightbox aspect of this invention, the even subdued illumination from behind the slide, provides the optimum conditions for viewing such transparencies without any surfaces between the surface of the slide and the person viewing the slide. The combination of a lightbox with a lampshade allows the convenient viewing and study of such slides in a social environment, as in a home. The slides are mounted in an easily viewable vertical orientation which does not require bending over to view, as does a conventional lightbox. Slides can be easily removed and replaced in order to view and display new additions to one's slide collection. Furthermore, the normal function of a lampshade in diffusing light and eliminating the glare of a naked bulb is in no way impaired by the lightbox lampshade. In addition, the collapsible feature of the combination lightbox lampshade allows easy and convenient storage of the lightbox lampshade when its use is no longer desired.

The objective of this invention is to provide a lampshade upon which photographic slides may be displayed for study and examination without the imposition of any surface between the surface of the slide and the viewer of the slide.

Another objective is to provide a lampshade with the ornamental and functional aspects of a conventional lampshade.

Another objective is to provide a lightbox lampshade which is collapsible for convenient storage.

Another objective is to provide a lightbox lampshade having a variety of number of sides for obtaining desired decorative purposes.

Another objective is to provide a lightbox lampshade where photographic slides may be changed when desired.

Another objective is to provide a lightbox lampshade which requires less space than a conventional lightbox and a conventional lampshade.

A final objective is to provide a lightbox lampshade which may be manufactured from inexpensive materials without adverse effect on the environment.

DETAILED DESCRIPTION OF THE INVENTION

Figure 1:
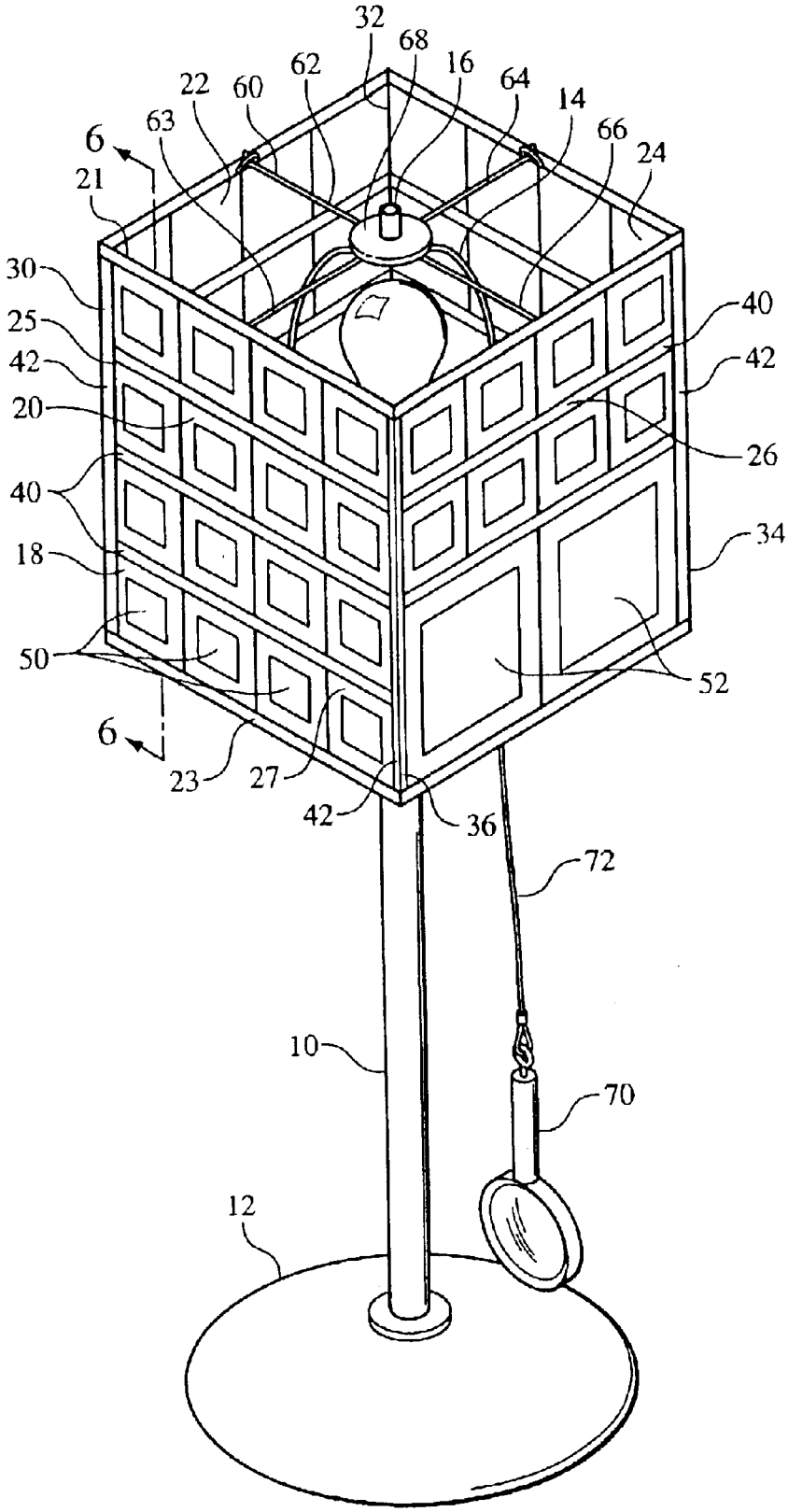
FIG. 1 is a plan view of the first embodiment lightbox lampshade.

FIG. 1 is a plan view of the first embodiment lightbox lampshade 18. A base 12 rests on the floor and supports a post 10 which supports a conventional light fixture (not visible in FIG. 1) with a harp lampshade support 14 and a threaded post (not visible in FIG. 1) at the top of the harp and a filial 16 with corresponding threads attached to the post.

Visible in FIG. 1 are the front 20, left 22, back 24, and right 26 sides of the lampshade. Each side is approximately rectangular, with the upper edge 21 approximately equal to the lower edge 23, and the right edge 27 approximately equal to the left edge 25. The sides are connected to each other by front left 30, left back 32, back right 34, and front right 36 hinges.

The lightbox lampshade is attached to the lamp through an upper support 60 attached at the top of the lampshade and a lower support (not visible in FIG. 1) attached at the bottom of the lampshade. The upper support 60 includes a collar 68 which is rotatable attached to the post (not visible in FIG. 1) at the top of the harp 14 and is retained in place by a filial 16 attached by screw threads to the post. The collar 68 rotates on the post which allows rotation of the lampshade to facilitate viewing of the left 22 and back 24 sides of the lampshade. The left support rod 62 connects the collar 68 and left side 22. The front support rod 63 connects the collar 68 and front side 20. The back support rod 64 connects the collar 68 and back 24 side. The right support rod 66 connects the collar 68 and front side 20. Further details concerning attachment of the lampshade to the lamp are in FIG. 7. A lower support is not shown in FIG. 1 but is shown as 80 in FIG. 7.

Removal of the lightbox lampshade 18 from the lamp and detachment of the upper support 60 and lower support (not visible in FIG. 1, 80 in FIG. 7) from the lampshade allows the lightbox lampshade to be collapsed through the movement of the hinged sides. Collapse of the lampshade allows convenient storage of the lampshade when not in use. Further details on hinges are in FIGS. 8 and 9.

Small 50 or large 52 transparent slides are transparent film photographs which may be mounted in cardboard mounts.

Figure 5:
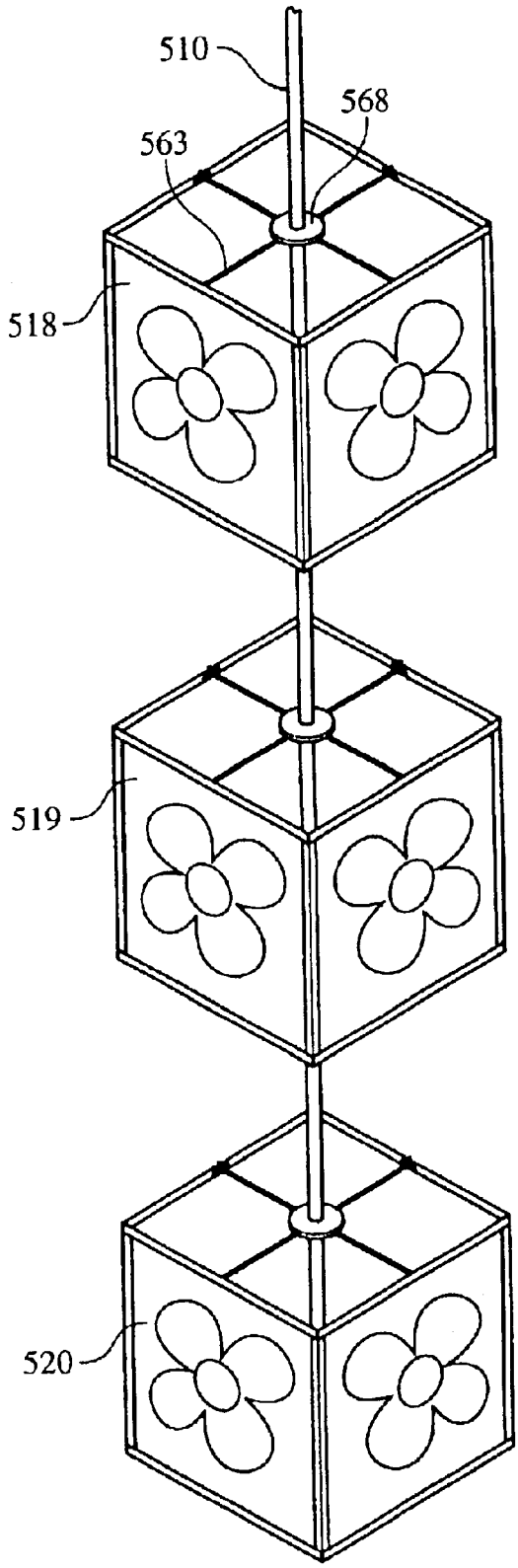
FIG. 5 is a plan view of the fifth embodiment lightbox lampshade.
Figure 6:
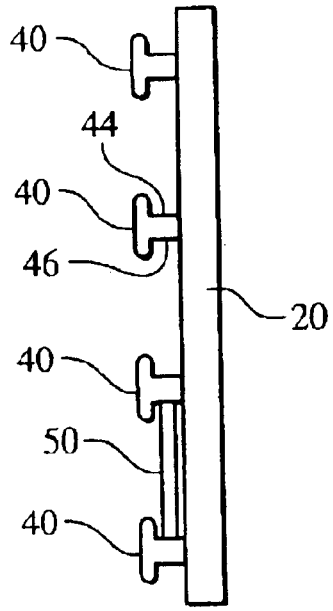
FIG. 6 is a cross-section view through line 6—6 of FIG. 1.

Horizontal runners 40 are used to retain small 50 or large 52 transparent slides against the sides for display and viewing of the slides which are illuminated by the light transmitted through the translucent sides. The horizontal runners 40 are supported by vertical runners 42. The horizontal runners 40 may be moved up and down and may be removed to accommodate transparent slides of varying sizes. Further details on the runners are shown in FIGS. 5 and 6.

A magnifying glass 72 is retained by a cord 70. The magnifying glass may be used for enhanced viewing of details of the illuminated slides.

The slides 50, 52 may easily be removed and other slides substituted for them. This allows updating of the display when desired, for example, by displaying a collection of slides of specific vacation photographs. The lightbox lampshade is attractive and utilitarian even when no slides are on display, as it provides for diffused and indirect lighting which adds to the ambience of any room. The slides viewed on the lampbox lampshade are viewed by transmitted light and directly without any surfaces between the photographic slide and the viewer.

Figure 2:
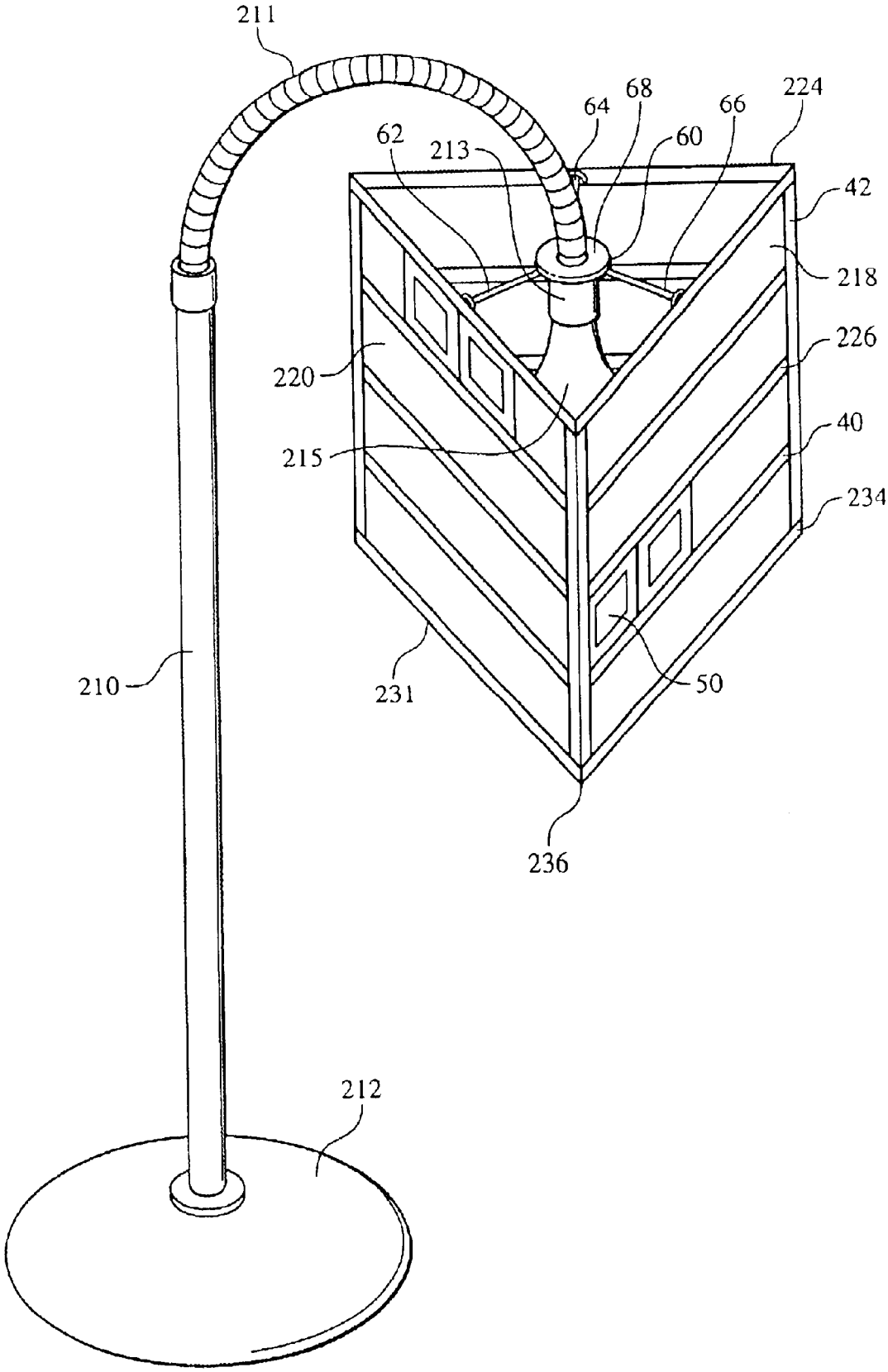
FIG. 2 is a plan view of the second embodiment lightbox lampshade.

FIG. 2 is a plan view of the second embodiment lightbox lampshade. The second embodiment is similar to the first embodiment except the second embodiment has three sides rather than four. In this example the second embodiment lampshade 218 is shown in use with a gooseneck lamp.

A base 212 rests on the floor and supports a post 210 which supports flexible gooseneck 211 to which is attached a conventional light socket 213 and light 215.

Figure 8:
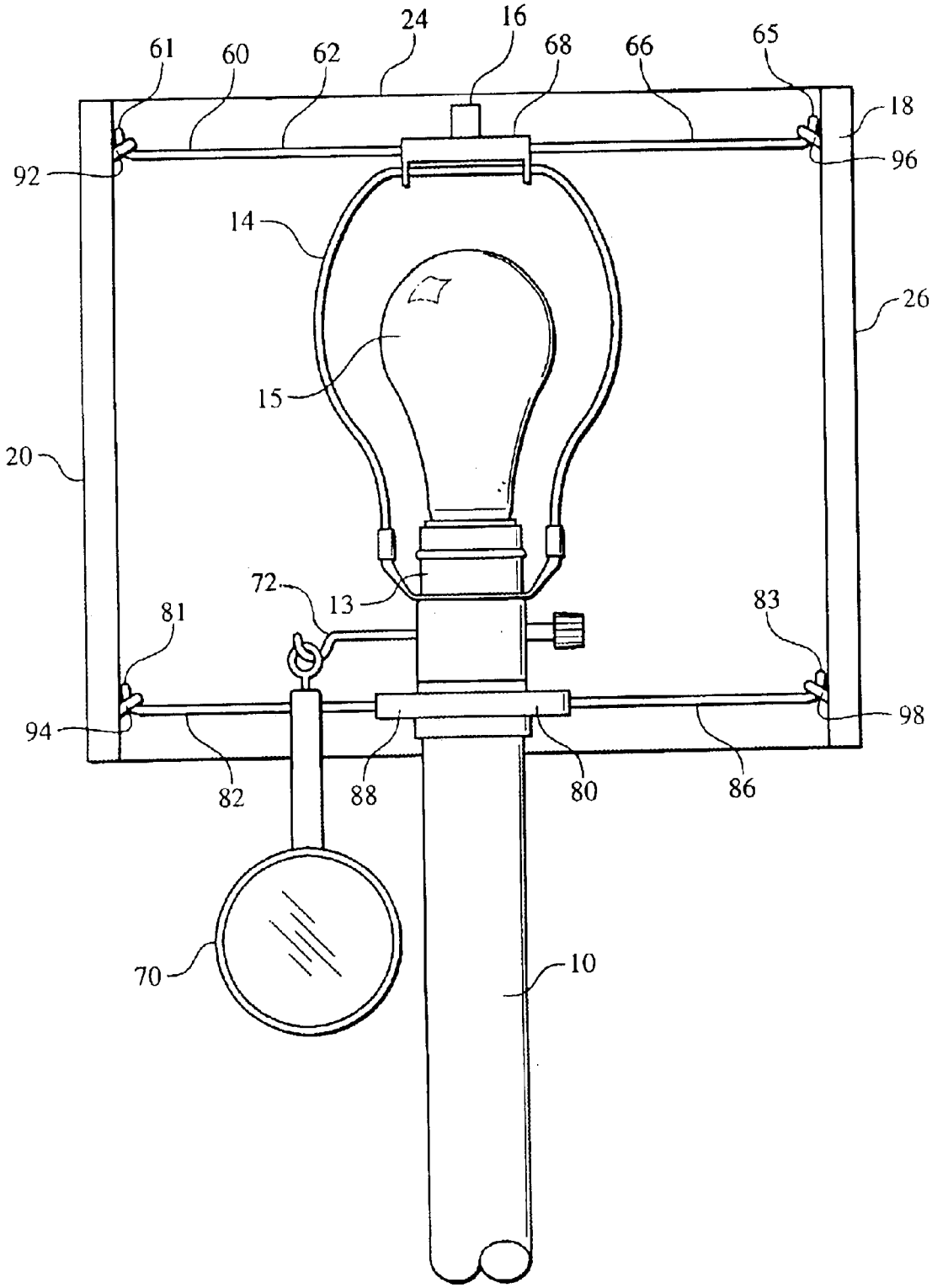
FIG. 8 is a plan view of the first embodiment lightbox lampshade with the front side removed.
Figure 9:
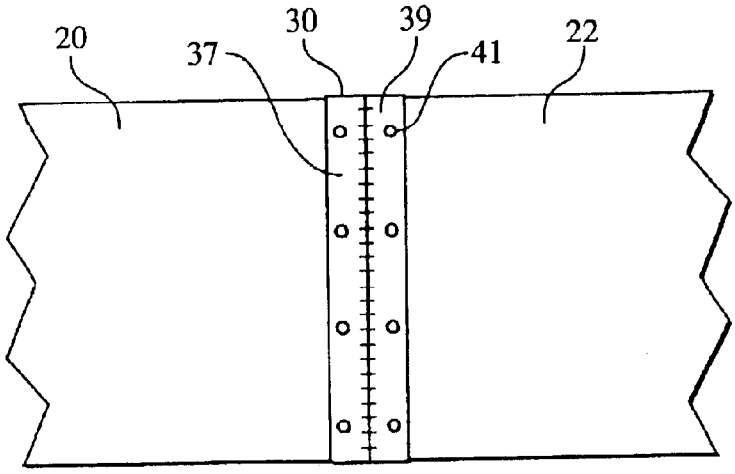
FIG. 9 shows details of a piano hinge between sides.

Visible in FIG. 2 are the front 220, back 224, and right 226 sides of the lampshade. The sides are connected to each other by front back 231, back right 234 and front right 236 hinges. At least one hinge in the second embodiment lampshade has provisions for detaching the hinged side's one from another. In this example, hinge 236 can be detached allowing separation of the front 220 and right 226 sides of the lampshade and allowing the lampshade to be collapsed for storage. Details on hinges are shown in FIGS. 8 and 9.

The lightbox lampshade is attached to the lamp through an upper support 60 attached at the top of the lamp socket 213. The upper support 60 includes a collar 68 which rotates on the lamp socket 213 to facilitate viewing of the back 224 side of the lampshade. The front support rod 63 connects the collar 68 and front side 220. The back support rod 64 connects the collar 68 and back 224 side. The right support rod 66 connects the collar 68 and right side 226.

Removal of the lightbox lampshade 218 from the lamp and detachment of the upper support 60 from the lampshade, and detachment of the front 220 from the right 226 sides at hinge 226 allows the lightbox lampshade to be collapsed through the movement of the hinges 231 and 234. Collapse of the lampshade allows convenient storage of the lampshade when not in use.

Horizontal 40 and vertical 42 runners hold transparent slides 50 as in the first embodiment.

A magnifying glass is not shown in FIG. 2

Figure 3:
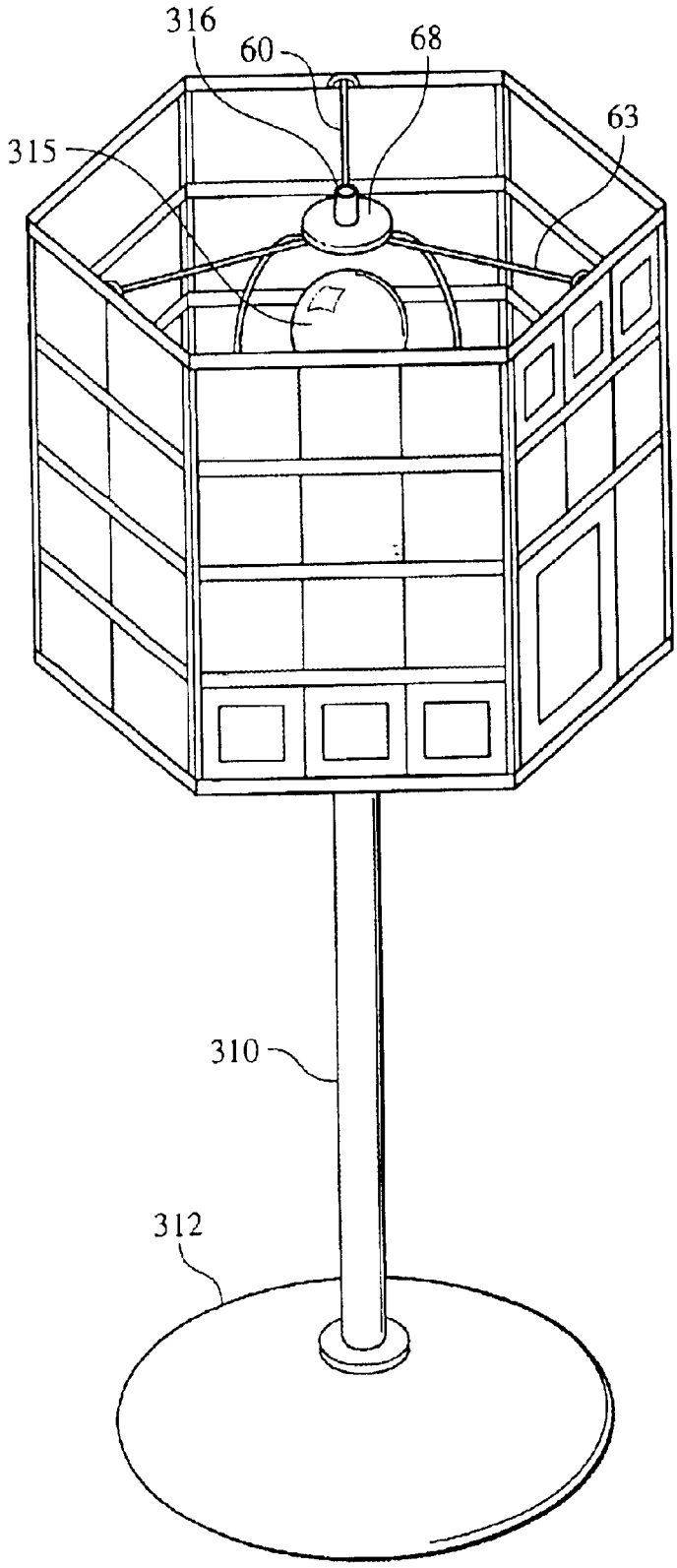
FIG. 3 is a plan view of the third embodiment lightbox lampshade.

FIG. 3 is a plan view of the third embodiment lightbox lampshade. The third embodiment is similar to the first embodiment except the third embodiment has six sides rather than four. In this example the third embodiment lampshade 318 is shown in use with a table lamp.

A base 312 rests on a table and supports a post 310 which a conventional light socket (not shown in FIG. 3) and light 315.

The lightbox lampshade is attached to the lamp through an upper support 60 attached at the top of the lamp 315 by a wire clip 316 which is friction fitted about the top portion of the bulb. The upper support 60 includes a collar 68 which rotates to facilitate viewing of the back sides of the lampshade. The support rods 63 connect the collar 68 and alternate sides of the lampshade. A lower support such as 80 in FIG. 7 also supports the third embodiment lightbox lampshade.

Figure 4:
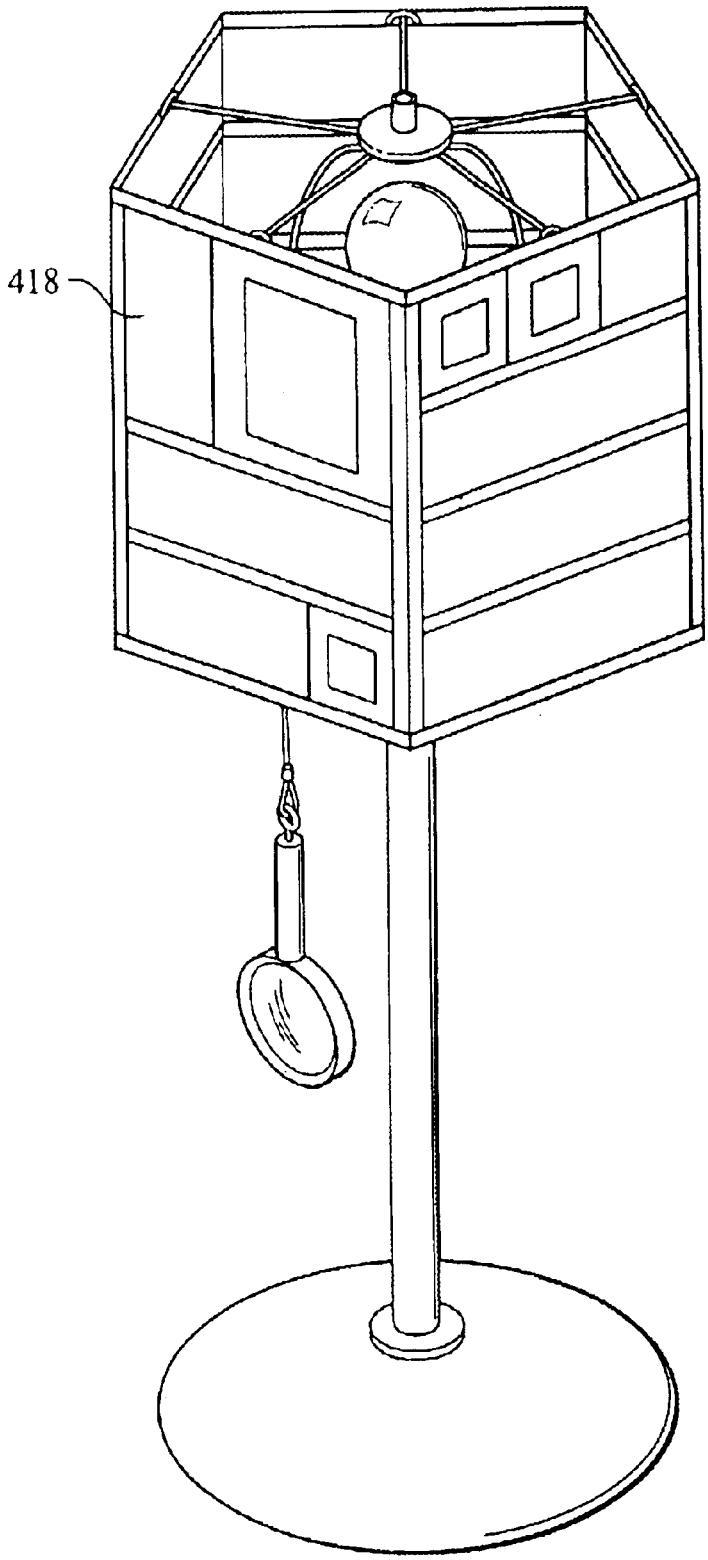
FIG. 4 is a plan view of the fourth embodiment lightbox lampshade.

FIG. 4 is a plan view of the fourth embodiment lightbox lampshade 418. The fourth embodiment is the same as the first embodiment except there are five sides rather than four.

FIG. 5 is a plan view of the fifth embodiment lightbox lampshade 518. The fifth embodiment is the same as the first embodiment except the lampshade 518 hangs from the ceiling. The lampshade 518 is supported by a conduit 510 attached to the ceiling which conducts the electrical supply wires and also provides physical support to the lamp. The lampshade 518 is attached to the conduit 510 by a collar 568 to which are attached multiple support rods 563. Additional lampshades 519 and 520 and associated lamps may be attached to the conduit.

FIG. 6 is a cross-section of a portion of the front side 20 of the first embodiment lampshade taken along the line &6 in FIG. 1. Visible in FIG. 6 is the front side 20, runners 40, and attached slide 50. Each runner 40 has an upper lip 44 and a lower lip 46. A slide 50 is removably retained on the front side by the runner lips.

Figure 7:
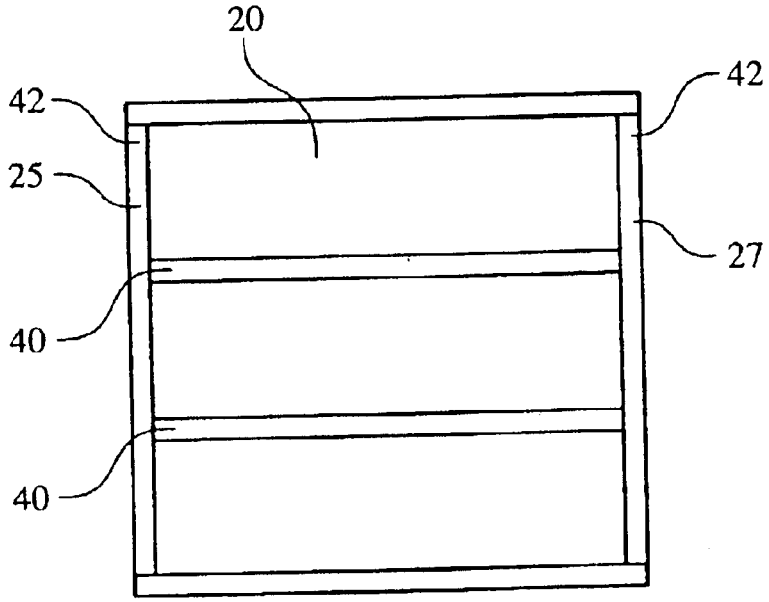
FIG. 7 shows the relation between horizontal and vertical runners.

FIG. 7 shows the relationship between the horizontal runners 40 and the vertical runners 42 on the front side 20. The vertical runners 42 are C-shaped and are attached by the bottom of the C to the left 25 edge and the right 27 edge of the front side 20. The horizontal runners are retained by the C-shaped vertical runners. The horizontal runners can be removed and the spacing between horizontal runners can be changed to accommodate slides of various sizes.

FIG. 8 is a plan view of the first embodiment lightbox lampshade with the front side 20 in FIG. 1 removed. Vertical and horizontal runners are not shown in FIG. 8. FIG. 8 shows the post 10, light socket 13, light bulb 15, and harp 14 which is surmounted by a filial 16 which is threaded attached to a post at the top of the harp (post not visible in FIG. 8). Also visible in FIG. 8 are the left side 22, right side 26, and rear side 24.

The lampshade is removably connected to the lamp by the upper support 60 and lower support 80. The lampshade can be rotated to display the back side and the upper support and lower support can be detached from the sides in order to allow the lampshade to be collapsed.

The upper support 60 can be rotated on the post at the top of the harp 14. Components of the upper support 60 visible in FIG. 8 include the collar 68, left support rod 62, and right support rod 66. A left support rod hook 61 is at the end of the left support rod 62, and connects with the left upper loop 92 attached to the left side 22. A right support rod hook 65 is at the end of the right support rod 66, and connects with the right upper loop 96 attached to the right side 26.

The lower support 80 can be rotated on the light socket 13 at the top of the post 10. Components of the lower support 80 visible in FIG. 8 include the collar 88, lower left support rod 82, and lower right support rod 86. A lower left support rod hook 81 is at the end of the lower left support rod 82, and connects with the left lower loop 94 attached to the left side 22. A lower right support rod hook 83 is at the end of the lower right support rod 86, and connects with the right lower loop 98 attached to the right side 26.

The upper connector 60 can be removed from the lamp by unscrewing the finial 16. The lower connector 80 can be removed from the lamp by removing the bulb 15 and harp 14 and sliding the lower connector 80 upward over the lamp socket 13.

Although FIG. 8 shows a hook and loop mechanism for connecting the connectors to the sides, other suitable methods of making reversible or demountable connections can be used, such as a screw and screw eye or a hook at the end of the rod and hole in the side. A magnifying glass 70 is attached by a hook 72 protruding from the side of light socket 13.

FIG. 9 shows details of a piano hinge 30 connecting the front side 20 with the left side 22 of the first embodiment lightbox lampshade. The left wing 37 of the hinge is attached to the front side 20 by fasteners 31 and the right wing 39 is connected to the left side 22 by fasteners 31. In this example screws are used as fasteners, but any suitable fasteners may be used, such as brads, bolts, or the hinge may be connected to the sides by adhesive.

Figure 10:
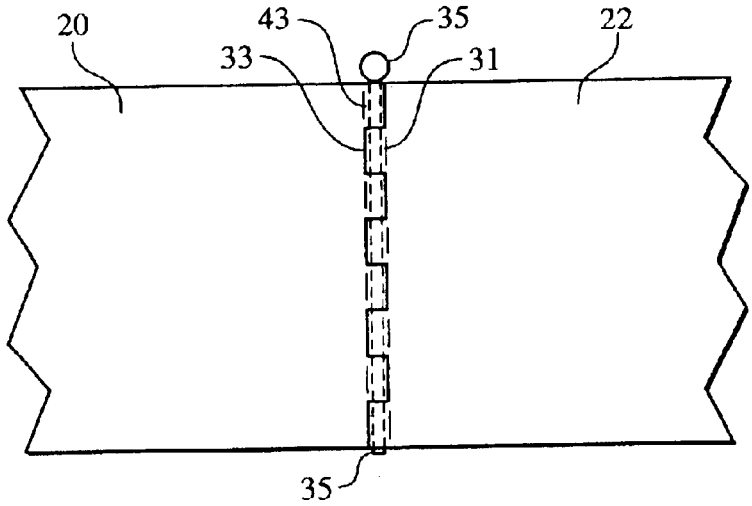
FIG. 10 shows details of a tongue and groove hinge between sides.

FIG. 10 shows details of a tongue and groove hinge 43 connecting the front side 20 with the left side 22 of the first embodiment lightbox lampshade. Tongues 31 and grooves 33 are cut into the sides. A hole (not shown in FIG. 10) is drilled from the top of the sides through the tongues and grooves. A removable pin 35 is inserted through the hole which connects the sides in a movable hinge which allows collapse of the lampshade. Removal of the pin detaches the two sides, a process which is necessary for the collapse of the second embodiment lampshade.

Figure 11:
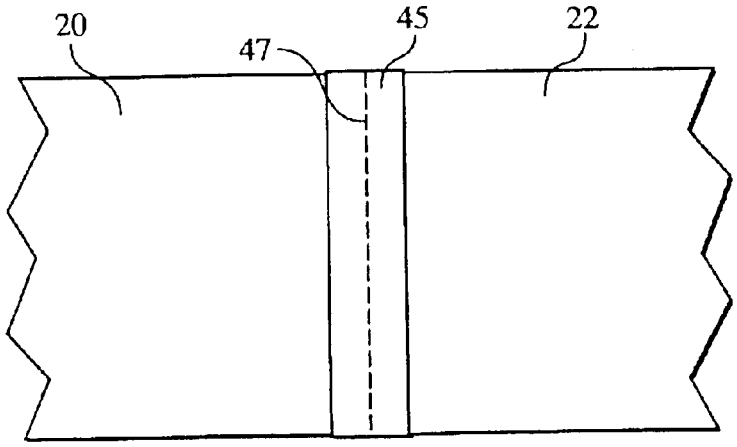
FIG. 11 shows details of a living hinge between sides.

FIG. 11 shows a living-hinge 45 connecting the sides 20 and 22. A living-hinge 45 is a flexible hinge the sides of which are attached to the sides 20 and 22 by any suitable means such as described with reference to FIG. 9. A preferred material of manufacture of the living hinge is any suitable strong flexible material such as fabric, plastic, tape, or cardboard. A preferred method of attachment of the living hinge is by adhesive.

Figure 12:
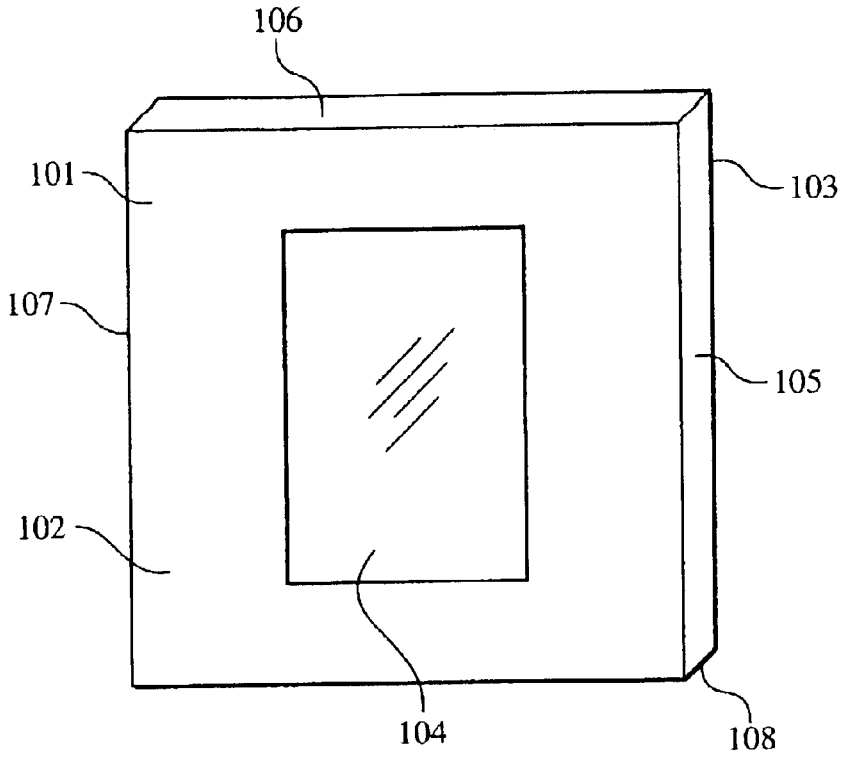
FIG. 12 shows details of a sleeve for use with a vertically-oriented slide.

FIG. 12 is a plan view of a first embodiment sleeve 101 which is used to cover a photographic slide containing a vertically-oriented photograph. The sleeve comprises a front 102 side, back 103 side, top 106 and bottom 108. A vertically-oriented window 104 is cut into the front 102 and back 103 sides. The right 105 and left 107 ends of the sleeve 101 are open and allow insertion of a photographic slide. Illumination from the translucent side of the lampshade is transmitted through the windows in the back side, is transmitted through the photograph, and emerges through the window 104 on the front 102 side of the sleeve 101. No surface is between the photographic slide and the viewer. The purpose of the sleeve is to cover the cardboard supports or mounts of photographic sides which may be of various colors, may have become soiled or discolored by time, or may bear undesirable indicta. Use of the sleeve with each photographic slide provides a more attractive lampbox lampshade.

Figure 13:
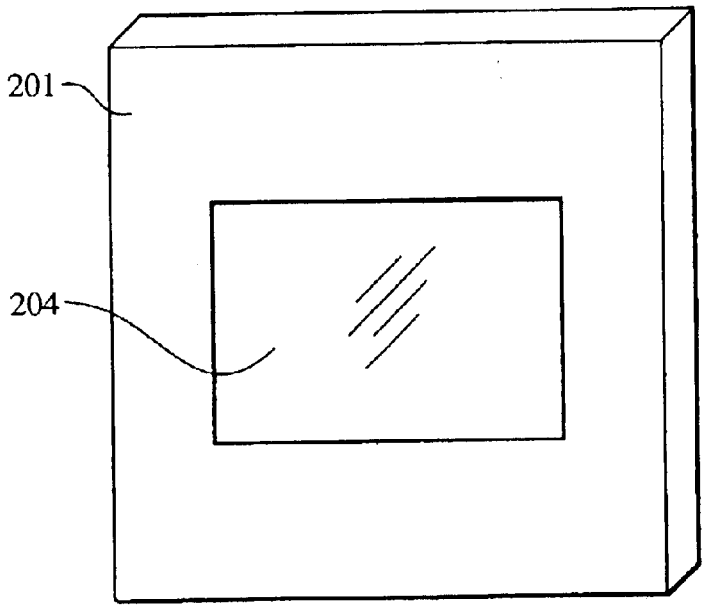
FIG. 13 shows details of a sleeve for use with a horizontally-oriented slide.

FIG. 13 is a plan view of a second embodiment sleeve 201. The second embodiment is identical to the first embodiment except the window 204 in the front side is horizontally-oriented rather than vertically-oriented in order to accommodate photographic slides bearing a horizontally-oriented photograph.

Figure 14:
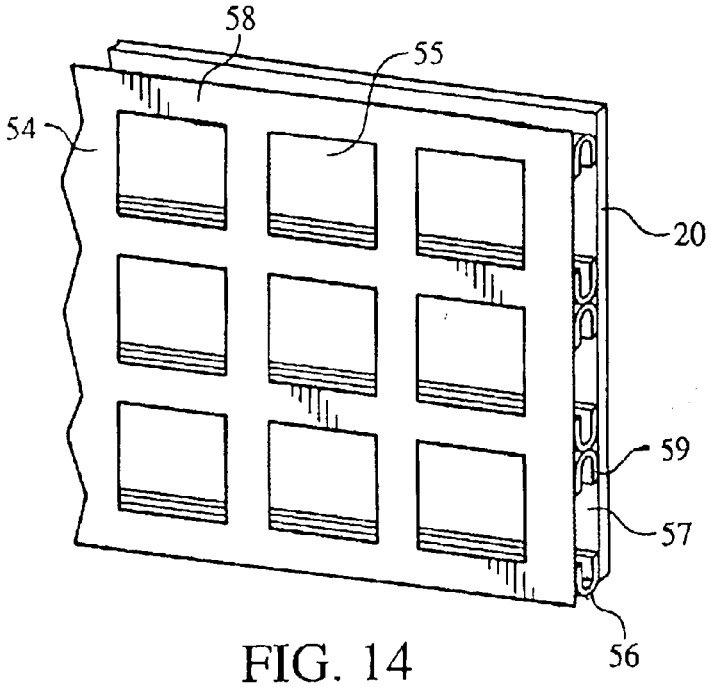
FIG. 14 is a perspective view of the second embodiment side.

FIG. 14 is a perspective view of a second embodiment side 54. The second embodiment side is a sandwich comprised of a translucent side 20 which is identical to the first embodiment side, attached to side 20 are a number of lower horizontal runners 56 and upper horizontal runners 59 and attached to the lower horizontal runners 56 and upper horizontal runners 59 is the front layer 58. The front layer 58 has an array of windows 55 cut into it. Photographic slides (not shown in FIG. 14 are inserted into the space 57 between the side 20 and front layer 58 and are supported by the horizontal runners 56. The photographic slides therefore are viewed by transmitted light and without any surfaces interspersed between the surface of the photographic slide and the viewer. The photographic slides are oriented so each photograph is behind a window. Light from the lamp is transmitted through the translucent side 20, illuminates the photographic slide, and is viewed through the window 55. The runners shown in this embodiment are U-shaped with the straight portion of one arm attached to the side 20 and the straight portion of the other arm attached to the back surface of the front layer 58. Any runner can be used.

Figure 15:
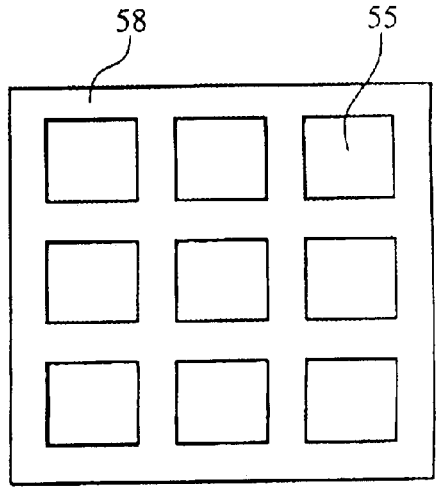
FIG. 15 is a plan view of the front surface of the front layer of the second embodiment side.

FIG. 15 shows the front layer 58 of the second embodiment side. The front surface, the surface most distant from the lamp, is shown in FIG. 15. The windows 55 are used to view vertically-oriented photographic slides in this depiction. Rotation of the window through a one-quarter turn allows the use of this front layer with horizontally-oriented photographic slides. The front layer 58 can be constructed of any suitable strong light material, but a non-transparent material is preferred in order to provide a desirable uniform appearance for the front layer. Use of the second embodiment side covers the cardboard mounts of photographic sides which may be of various colors, may have become soiled or discolored by time, or may bear undesirable indicta. The front layer is preferably made of frosted, ribbed, or sand blasted plastic. The front layer may be colored as desired.

Figure 16:
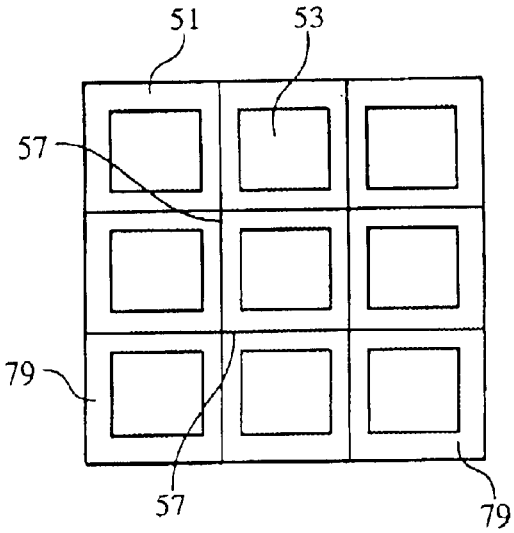
FIG. 16 is a plan view of the back surface of a third embodiment side.

FIG. 15 shows the back surface of the third embodiment 51 side. The front surface of the third embodiment side is identical to the front surface of the front layer of the second embodiment side. The back surface is the surface which is closest to the lamp. In this third embodiment 51, the photographic slides are supported on the back surface of a one piece side. The third embodiment side has windows 53 cut into the side for viewing of photographic slides which are mounted on the back surface of the third embodiment side and are illuminated by the lamp. The photographic slides are retained on the back surface of the third embodiment side by flanges 57 forming chambers 79 and tabs on the flanges (not shown in FIG. 16) which retain one slide in each chamber.

Figure 17:
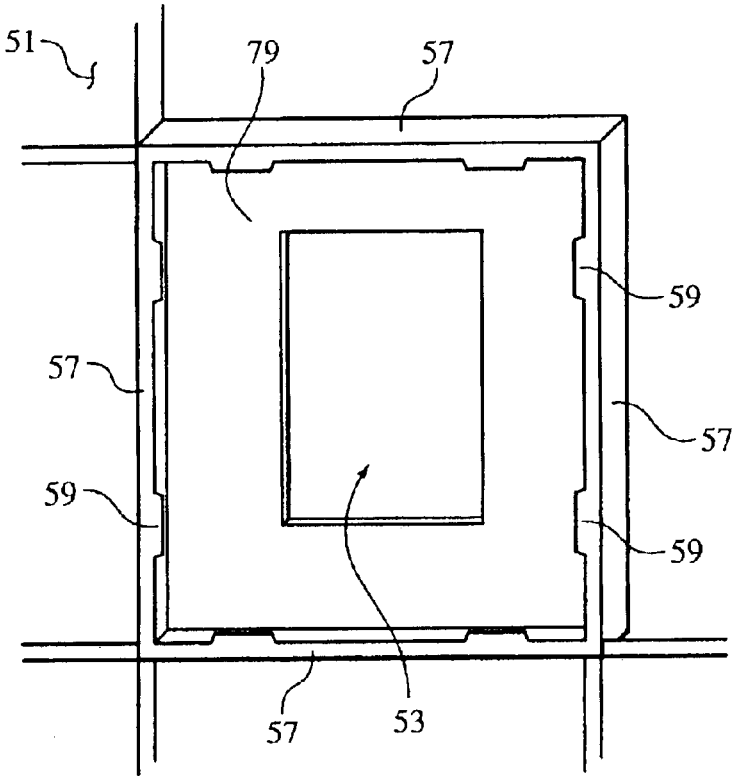
FIG. 17 is an enlarged view of a slide holder on the back surface of the third embodiment side.

FIG. 17 is an enlargement of a portion of the back surface of the third embodiment side 51. Visible in FIG. 17 is a window 53 through which a photographic slide is viewed by transmitted light when attached to the third embodiment side and illuminated by a lamp. Flanges 57 extend from the back surface of the third embodiment side forming a chamber which which retains one photographic slide. In this example, the flanges 57 extend approximately ⅛ inch from the surface of the third embodiment side forming a chamber 79 which accommodates one photographic slide. Tabs 59 extend from the sides of flanges 57 and serve to retain the photograph slide in the chamber 79.

Figure 18:
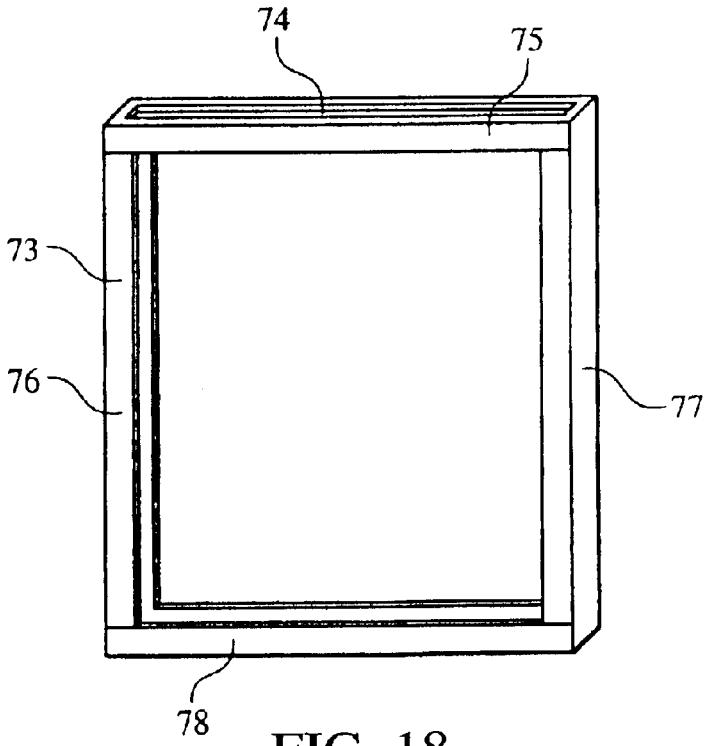
FIG. 18 is a plan view of a frame for sides.

FIG. 18 is a plan view of a first embodiment frame 73. The frame is constructed of U-shaped material with a top 75, bottom 78, left 76 and right 77 edges. The top 75 has a slot 74. The frame 73 is constructed by connecting the edges with the open portion of the U-shaped edges directed toward the interior of the frame. A first, second, or third embodiment side is inserted into the slot 74 and retained by the U-shaped edges. The left 76 edge of one frame is hinged to the right 77 edge of an adjacent frame, forming the framework of a lightbox lampshade. The use of a frame allows convenient alteration of the sides used with a lightbox lampshade.

Each lightbox lampshade allows the viewing of a photographic slide by transmitted light from the lamp and without any optical surface between the illuminated photographic slide and the viewer.

The various embodiment lightbox lampshades have been shown with floor, table, and gooseneck bases and a conduit which support the lamps and lampshades. Any embodiment lightbox lampshade can be used with any type of base.

The sides of the lightbox lampshades of this invention may be manufactured of any rigid, translucent material which allows the diffusion and transmission of light. Preferred materials include translucent plastic or ground glass.

The lamps and lamp posts and bases are conventional and well known in the art.

It will be apparent to those skilled in the art that the examples and embodiments described herein are by way of illustration and not of limitation, and that other examples may be used without departing from the spirit and scope of the present invention, as set forth in the following claims.

I claim:

1. A combination lightbox lampshade for viewing of photographic slides by a viewer comprising:

three or more flat sides comprised of translucent material, each side having an upper edge, a lower edge, a left edge and a right edge, an inner surface and an outer surface, each side hingedly attached by a right edge to the left edge of an adjacent side, thereby forming a lampshade with the upper edges forming a polygon, with the inner surfaces of the flat sides facing the inside of the polygon, at least one side having a multiplicity of holders for removably attaching a multiplicity of photographic slides to the flat sides, and the lightbox lampshade having removable connectors for connecting the lightbox lampshade to a lamp, wherein no surfaces are between the surface of each photographic slide attached to the flat sides and the viewer of the photographic slides.

2. The lightbox lampshade of claim 1 wherein the holders are located on the outer surfaces of the flat sides.

3. The lightbox lampshade of claim 1 wherein each flat side is comprised of a translucent side, horizontal runners, and a front layer with windows for viewing the photographic slides, the horizontal runners acting as holders for removably attaching the multiplicity of photographic slides to each flat side, the horizontal runners located between and attached to both the translucent side and the front layer.

4. The lightbox lampshade of claim 3 wherein the front layer is non-transparent.

5. The lightbox lampshade of claim 1 wherein each flat side has windows for viewing of the photographic slides and holders for removably attaching the multiplicity of photographic slides attached to the inner surface of each flat side, the holders comprising flanges and tabs.

6. The lightbox lampshade of claim 1 wherein the sides are hingedly attached to the adjacent side via frames which are hingedly attached to adjacent frames, each frame comprised of U-shaped material with a slot at the top of each frame for the insertion of each flat side.

7. The lightbox lampshade of claim 1 wherein the translucent material is translucent plastic.

8. The lightbox lampshade of claim 1 wherein the translucent material is ground glass.

9. The lightbox lampshade of claim 1 wherein each side is attached to the adjacent side by piano hinges.

10. The lightbox lampshade of claim 1 wherein each side is attached to the adjacent side by notch and pin hinges.

11. The lightbox lampshade of claim 1 wherein each side is attached to the adjacent side by a living-hinge.

12. The lightbox lampshade of claim 1 further comprising sleeves which cover photographic slide mounts.

13. The lightbox lampshade of claim 1 further comprising a magnifying glass for examining the photographic slides, the magnifying glass attached to the lampshade by a flexible connector.

14. The lightbox lampshade of claim 1 further comprising a table lamp.

15. The lightbox lampshade of claim 1 further comprising a floor lamp.

16. The lightbox lampshade of claim 1 further comprising a gooseneck lamp.

17. The lightbox lampshade of claim 1 wherein the lightbox lampshade is suspended from a ceiling.

18. The lightbox lampshade of claim 1 further comprising a detachable hinge attaching at least two of the sides.

19. The lightbox lampshade of claim 1 wherein the length of the top edge of each side is approximately that of the length of the lower edge of the side.

20. The lightbox lampshade of claim 1 wherein the length of the left edge of each flat side is approximately that of the length of the lower edge of that side.

* * * * *